US008588640B2

(12) United States Patent
Kubo et al.

(10) Patent No.: US 8,588,640 B2
(45) Date of Patent: Nov. 19, 2013

(54) ELECTRICAL CONNECTION STRUCTURE, ELECTRICAL CONNECTION METHOD, ELECTRICAL CONNECTION MEMBER, AND IMAGE FORMING APPARATUS

(75) Inventors: Ryouta Kubo, Kanagawa (JP); Hirohisa Hoshino, Kanagawa (JP); Tomoya Ichikawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 314 days.

(21) Appl. No.: 13/095,397

(22) Filed: Apr. 27, 2011

(65) Prior Publication Data

US 2012/0114365 A1 May 10, 2012

(30) Foreign Application Priority Data

Nov. 9, 2010 (JP) ..... 2010-250733

(51) Int. Cl.
*G03G 15/00* (2006.01)

(52) U.S. Cl.
USPC ..... 399/90

(58) Field of Classification Search
USPC ..... 399/88, 90, 354; 439/13, 25–29
See application file for complete search history.

(56) References Cited

U.S. PATENT DOCUMENTS

| | | | | |
|---|---|---|---|---|
| 6,064,841 | A * | 5/2000 | Matsuzaki et al. | 399/90 |
| 6,411,794 | B1 * | 6/2002 | Muto | 399/90 |
| 8,005,392 | B2 * | 8/2011 | Ishii et al. | 399/90 |
| 2005/0214018 | A1 * | 9/2005 | Hale et al. | 399/90 |
| 2005/0220476 | A1 | 10/2005 | Kakitani et al. | |
| 2011/0268467 | A1 * | 11/2011 | Ishii et al. | 399/90 |

* cited by examiner

*Primary Examiner* — Susan Lee
(74) *Attorney, Agent, or Firm* — Sughrue Mion, PLLC

(57) ABSTRACT

An electrical connection structure includes a holder that holds an electric terminal provided with an electrical contact portion having elasticity and held such that the electrical contact portion is elastically deformable; a guiding member fitted to the holder and capable of guiding the holder in first and second directions, which are substantially orthogonal to each other, to move the electrical contact portion to a predetermined contact position on a conductive member, the first direction being a direction in which the electrical contact portion is elastically deformed by being pressed against the conductive member; and a restraining member that comes into contact with the holder that has been guided by the guiding member to move the electrical contact portion to the contact position, the restraining member restraining the holder from being moved in a direction opposite to the first direction by an elastic reaction force applied to the holder.

11 Claims, 8 Drawing Sheets

ELECTRICAL CONNECTION STRUCTURE, ELECTRICAL CONNECTION METHOD, ELECTRICAL CONNECTION MEMBER, AND IMAGE FORMING APPARATUS

CROSS-REFERENCE TO RELATED APPLICATIONS

This application is based on and claims priority under 35 USC 119 from Japanese Patent Application No. 2010-250733 filed Nov. 9, 2010.

BACKGROUND

The present invention relates to an electrical connection structure, an electrical connection method, an electrical connection member, and an image forming apparatus including the electrical connection structure.

SUMMARY

According to an aspect of the invention, there is provided an electrical connection structure including a holder that holds an electric terminal provided with an electrical contact portion having elasticity, the electric terminal being held such that the electrical contact portion is elastically deformable; a guiding member fitted to the holder and capable of guiding the holder in a first direction and a second direction to move the electrical contact portion to a predetermined contact position on a conductive member, the first direction being a direction in which the electrical contact portion is elastically deformed by being pressed against the conductive member and the second direction being substantially orthogonal to the first direction; and a restraining member that comes into contact with the holder that has been guided by the guiding member to move the electrical contact portion to the contact position, the restraining member restraining the holder from being moved in a direction opposite to the first direction by an elastic reaction force applied to the holder.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described in detail with reference to the drawings.

Basic Structure of Image Forming Apparatus

Figure 1:
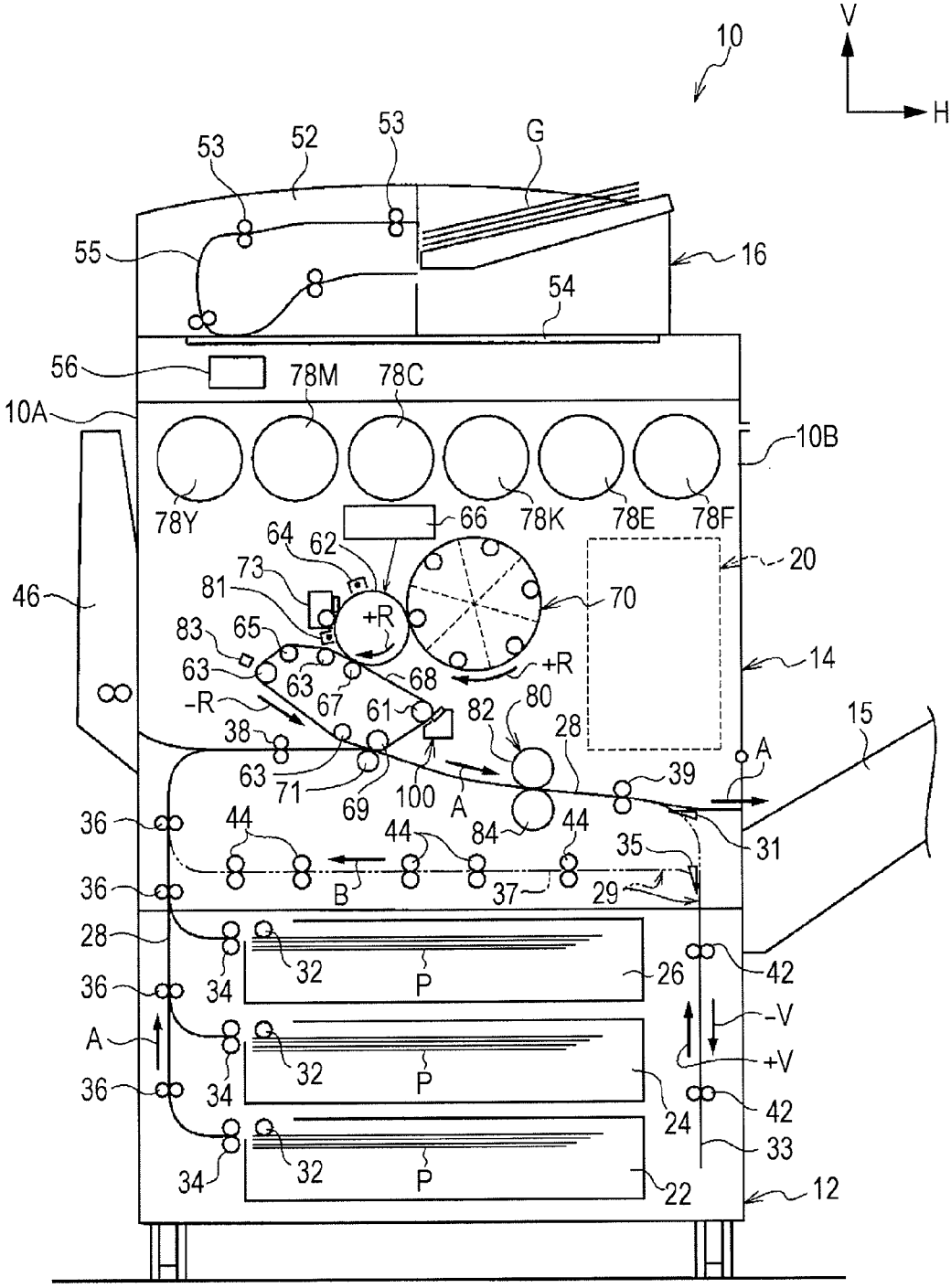
FIG. 1 illustrates the structure of an image forming apparatus according to an exemplary embodiment.

First, the structure of an image forming apparatus according to the present exemplary embodiment will be described. FIG. 1 is a schematic diagram illustrating the structure of an image forming apparatus 10 according to the present exemplary embodiment.

The image forming apparatus 10 includes a sheet storing unit 12 in which the recording paper P is stored; an image forming unit 14 which is located above the sheet storing unit 12 and forms images on sheets of recording paper P fed from the sheet storing unit 12; and an original-document reading unit 16 which is located above the image forming unit 14 and reads an original document G. The image forming apparatus 10 also includes a controller 20 that is provided in the image forming unit 14 and controls the operation of each part of the image forming apparatus 10. In the following description, the vertical direction and the horizontal direction with respect to an apparatus body 10A of the image forming apparatus 10 will be referred to as the direction of arrow V and the direction of arrow H, respectively.

The sheet storing unit 12 includes a first storage unit 22, a second storage unit 24, and a third storage unit 26 in which sheets of recording paper P having different sizes are stored. Each of the first storage unit 22, the second storage unit 24, and the third storage unit 26 are provided with a feeding roller 32 that feeds the stored sheets of recording paper P to a transport path 28 in the image forming apparatus 10. Pairs of transport rollers 34 and 36 that transport the sheets of recording paper P one at a time are provided along the transport path 28 in an area on the downstream of each feeding roller 32. A pair of positioning rollers 38 are provided on the transport path 28 at a position downstream of the transport rollers 36 in a transporting direction of the sheets of recording paper P. The positioning rollers 38 temporarily stop each sheet of recording paper P and feed the sheet toward a second transfer position, which will be described below, at a predetermined timing.

In the front view of the image forming apparatus 10, an upstream part of the transport path 28 extends in the direction of arrow V from the left side of the sheet storing unit 12 to the lower left part of the image forming unit 14. A downstream part of the transport path 28 extends from the lower left part of the image forming unit 14 to a paper output unit 15 provided on the right side of the image forming unit 14. A duplex-printing transport path 29, which is provided for reversing and transporting each sheet of recording paper P in a duplex printing process, is connected to the transport path 28.

In the front view of the image forming apparatus 10, the duplex-printing transport path 29 includes a first switching member 31, a reversing unit 33, a transporting unit 37, and a second switching member 35. The first switching member 31 switches between the transport path 28 and the duplex-printing transport path 29. The reversing unit 33 extends linearly in the direction of arrow V from a lower right part of the image forming unit 14 along the right side of the sheet storing unit 12. The transporting unit 37 receives the trailing end of each sheet of recording paper P that has been transported to the reversing unit 33 and transports the sheet in the direction of arrow H. The second switching member 35 switches between the reversing unit 33 and the transporting unit 37. The reversing unit 33 includes plural pairs of transport rollers 42 that are arranged with intervals therebetween, and the transporting unit 37 includes plural pairs of transport rollers 44 that are arranged with intervals therebetween.

The first switching member 31 has the shape of a triangular prism, and a point end of the first switching member 31 is moved by a driving unit (not shown) to one of the transport path 28 and the duplex-printing transport path 29. Thus, the transporting direction of each sheet of recording paper P is changed. Similarly, the second switching member 35 has the shape of a triangular prism, and a point end of the second switching member 35 is moved by a driving unit (not shown) to one of the reversing unit 33 and the transporting unit 37. Thus, the transporting direction of each sheet of recording paper P is changed. The downstream end of the transporting unit 37 is connected to the transport path 28 by a guiding member (not shown) at a position in front of the transport rollers 36 in the upstream part of the transport path 28. A foldable manual sheet-feeding unit 46 is provided on the left side of the image forming unit 14. The sheets of recording paper P may be fed to the positioning rollers 38 on the transport path 28 from the manual sheet-feeding unit 46.

The original-document reading unit 16 includes a document transport device 52 that transports the sheets of the original document G one at a time; a platen glass 54 which is located below the document transport device 52 and on which the sheets of the original document G are placed one at a time; and an original-document reading device 56 that scans each sheet of the original document G while the sheet is being transported by the document transport device 52 or placed on the platen glass 54. The document transport device 52 includes a transport path 55 along which pairs of transport rollers 53 are arranged. A part of the transport path 55 is arranged such that each sheet of the original document G moves along the top surface of the platen glass 54. The original-document reading device 56 scans each sheet of the original document G that is being transported by the document transport device 52 while being stationary at the left edge of the platen glass 54. Alternatively, the original-document reading device 56 scans each sheet of the original document G placed on the platen glass 54 while moving in the direction of arrow H.

The image forming unit 14 includes a cylindrical photoconductor 62 arranged in a substantially central area of the apparatus body 10A. The photoconductor 62 is rotated in the direction shown by arrow +R (clockwise in FIG. 1) by a driving unit (not shown), and carries an electrostatic latent image formed by irradiation with light. In addition, a corotron charging device 64 that charges the outer peripheral surface of the photoconductor 62 is provided above the photoconductor 62 so as to face the outer peripheral surface of the photoconductor 62.

An exposure device 66 is provided so as to face the outer peripheral surface of the photoconductor 62 at a position downstream of the charging device 64 in the rotational direction of the photoconductor 62. The outer peripheral surface of the photoconductor 62 that has been charged by the charging device 64 is irradiated with light (exposed to light) by the exposure device 66 on the basis of an image signal corresponding to each color of toner. Thus, an electrostatic latent image is formed.

A rotation-switching developing device 70 is provided downstream of a position where the photoconductor 62 is irradiated with exposure light by the exposure device 66 in the rotational direction of the photoconductor 62. The developing device 70 visualizes the electrostatic latent image on the outer peripheral surface of the photoconductor 62 by developing the electrostatic latent image with toner of each color. The developing device 70 will be described in detail below.

An intermediate transfer belt 68 is provided downstream of the developing device 70 in the rotational direction of the photoconductor 62 and below the photoconductor 62. A toner image formed on the outer peripheral surface of the photoconductor 62 is transferred onto the intermediate transfer belt 68. The intermediate transfer belt 68 is an endless belt, and is wound around a driving roller 61 that is rotated by the controller 20, a tension-applying roller 63 that applies a tension to the intermediate transfer belt 68, plural transport rollers 65 that are in contact with the back surface of the intermediate transfer belt 68 and are rotationally driven, and an auxiliary roller 69 that is in contact with the back surface of the intermediate transfer belt 68 at the second transfer position, which will be described below, and is rotationally driven. The intermediate transfer belt 68 is rotated in the direction shown by arrow −R (counterclockwise in FIG. 2) when the driving roller 61 is rotated.

A first transfer roller 67 is opposed to the photoconductor 62 with the intermediate transfer belt 68 interposed therebetween. The first transfer roller 67 performs a first transfer process in which the toner image formed on the outer peripheral surface of the photoconductor 62 is transferred onto the intermediate transfer belt 68. The first transfer roller 67 is in contact with the back surface of the intermediate transfer belt 68 at a position downstream of the position where the photoconductor 62 is in contact with the intermediate transfer belt 68 in the moving direction of the intermediate transfer belt 68. The first transfer roller 67 receives electricity from a power source (not shown), so that a potential difference is generated between the first transfer roller 67 and the photoconductor 62, which is grounded. Thus, the first transfer process is carried out in which the toner image on the photoconductor 62 is transferred onto the intermediate transfer belt 68.

A second transfer roller 71 is opposed to the auxiliary roller 69 with the intermediate transfer belt 68 interposed therebetween. The second transfer roller 71 performs a second transfer process in which toner images that have been transferred onto the intermediate transfer belt 68 in the first transfer process are transferred onto the sheet of recording paper P. The position between the second transfer roller 71 and the auxiliary roller 69 serves as the second transfer position at which the toner images are transferred onto the sheet of recording paper P. The second transfer roller 71 is in contact with the intermediate transfer belt 68. The second transfer roller 71 receives electricity from a power source (not shown), so that a potential dereference is generated between the second transfer roller 71 and the auxiliary roller 69, which is grounded. Thus, the second transfer process is carried out in which the toner images on the intermediate transfer belt 68 are transferred onto the sheet of recording paper P.

A cleaning device 100, which is an example of a developer collecting device, is opposed to the driving roller 61 with the intermediate transfer belt 68 interposed therebetween. The cleaning device 100 collects residual toner that remains on the intermediate transfer belt 68 after the second transfer process. The cleaning device 100 includes a cleaning blade 106 that comes into contact with the intermediate transfer belt 68 to remove the toner from the intermediate transfer belt 68. The cleaning blade 106 of the cleaning device 100 and the second transfer roller 71 are separated from the outer peripheral surface of the intermediate transfer belt 68 until the toner images of the respective colors are transferred onto the intermediate transfer belt 68 in a superimposed manner (first transfer process) and then transferred onto the sheet of recording paper P (second transfer process).

A position detection sensor 83 is opposed to the tension-applying roller 63 at a position outside the intermediate transfer belt 68. The position detection sensor 83 detects a predetermined reference position on the surface of the intermediate transfer belt 68 by detecting a mark (not shown) on the intermediate transfer belt 68. The position detection sensor 83 outputs a position detection signal that serves as a reference for the time to start an image forming process.

A cleaning device 73 is provided downstream of the first transfer roller 67 in the rotational direction of the photoconductor 62. The cleaning device 73 removes residual toner and the like that remain on the surface of the photoconductor 62 instead of being transferred onto the intermediate transfer belt 68 in the first transfer process. The cleaning device 73 collects the residual toner and the like with a cleaning blade 73A and a brush roller 73B that are in contact with the surface of the photoconductor 62. The collected residual toner and the like are discharged from the cleaning device 73 by a toner discharging device 73C that has an auger therein. An erase device 81 is provided upstream of the cleaning device 73 and downstream of the first transfer roller 67 in the rotational direction of the photoconductor 62. The erase device 81 removes the electric charge by irradiating the outer peripheral surface of the photoconductor 62 with light. The erase device 81 removes the electric charge by irradiating the outer peripheral surface of the photoconductor 62 with light before the residual toner and the like are collected by the cleaning device 73. Accordingly, the electrostatic adhesion force is reduced and the collection rate of the residual toner and the like is increased. An additional erase device for removing the electric charge after the collection of the residual toner and the like may be provided downstream of the cleaning device 73 and upstream of the charging device 64.

As illustrated in FIG. 1, the second transfer position at which the toner images are transferred onto the sheet of recording paper P by the second transfer roller 71 is at an intermediate position of the above-described transport path 28. A fixing device 80 is provided on the transport path 28 at a position downstream of the second transfer roller 71 in the transporting direction of the sheet of recording paper P (direction shown by arrow A). The fixing device 80 fixes the toner images that have been transferred onto the sheet of recording paper P by the second transfer roller 71. The fixing device 80 includes a heating roller 82 and a pressing roller 84. The heating roller 82 is disposed at the side of the sheet of recording paper P at which the toner images are formed (upper side), and includes a heat source which generates heat when electricity is supplied thereto. The pressing roller 84 is positioned below the heating roller 82, and presses the sheet of recording paper P against the outer peripheral surface of the heating roller 82. Transport rollers 39 that transport the sheet of recording paper P to the paper output unit 15 or the reversing unit 33 are provided on the transport path 28 at a position downstream of the fixing device 80 in the transporting direction of the sheet of recording paper P.

Toner cartridges 78Y, 78M, 78C, 78K, 78E, and 78F that respectively contain yellow (Y) toner, magenta (M) toner, cyan (C) toner, black (K) toner, toner of a first specific color (E), and toner of a second specific color (F) are arranged in the horizontal direction in a replaceable manner in an area below the original-document reading device 56 and above the developing device 70.

The first and second specific colors E and F may be selected from specific colors (including transparent) other than yellow, magenta, cyan, and black. Alternatively, the first and second specific colors E and F are not selected. When the first and second specific colors E and F are selected, the developing device 70 performs the image forming process using six colors, which are Y, M, C, K, E, and F. When the first and second specific colors E and F are not selected, the developing device 70 performs the image forming process using four colors, which are Y, M, C, and K.

The image forming apparatus 10 includes an opening-closing unit 10B that is capable of being opened or closed with respect to the apparatus body 10A. The opening-closing unit 10B is provided on the right side of the image forming unit 14.

Structure of Developing Device

The detailed structure of the developing device 70 will now be described.

Figure 2:
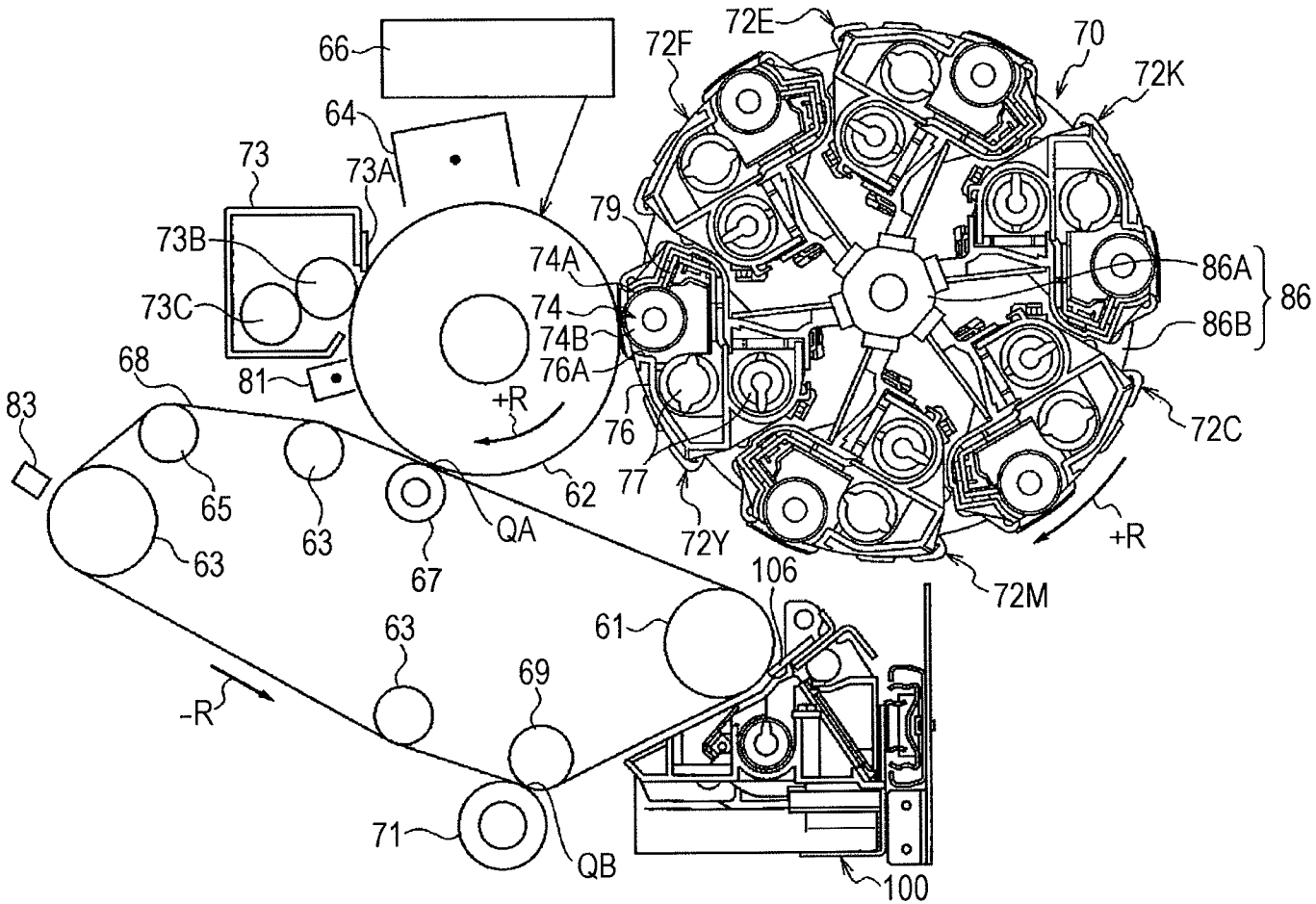
FIG. 2 illustrates the structure around a photoconductor according to the exemplary embodiment.

As illustrated in FIG. 2, the developing device 70 includes a rotating body 86 that is supported such that the rotating body 86 is rotatable with respect to the apparatus body 10A (see FIG. 1). The rotating body 86 includes a rotational shaft 86A that extends in the rotational axis direction of the rotating body 86 and flange members 86B provided at the ends of the rotational shaft 86A in the axial direction thereof. The flange members 86B expand outward from the rotational shaft 86A in the radial direction thereof.

Developing units 72Y, 72M, 72C, 72K, 72E, and 72F corresponding to the respective colors, which are yellow (Y), magenta (M), cyan (C), black (K), the first specific color (E), and the second specific color (F), respectively, are arranged in that order in a circumferential direction of the rotational shaft 86A (counterclockwise in FIG. 2) in the space between the two flange members 86B.

Referring to FIG. 2, the rotating body 86 included in the developing device 70 is rotated by a motor (not shown), which functions as a rotating unit, in steps of 60° in the direction shown by arrow +R. Accordingly, one of the developing units 72Y, 72M, 72C, 72K, 72E, and 72F that is to perform a developing process is selectively opposed to the outer peripheral surface of the photoconductor 62. The developing units 72Y, 72M, 72C, 72K, 72E, and 72F have similar structures. Therefore, only the developing unit 72Y will be described, and explanations of the other developing units 72M, 72C, 72K, 72E, and 72F will be omitted.

The developing unit 72Y includes a casing member 76, which serves as a base body. The casing member 76 is filled with developer (not shown) including toner and carrier. The developer is supplied from the toner cartridge 78Y (see FIG. 1) through a toner supply channel (not shown). The casing member 76 has a rectangular opening 76A that is opposed to the outer peripheral surface of the photoconductor 62. A developing roller 74 is disposed in the opening 76A so as to face the outer peripheral surface of the photoconductor 62. The developing roller 74 is rotatably supported by the casing member 76. A plate-shaped regulating member 79, which regulates the thickness of a developer layer that is transported by the developing roller 74, is provided along the longitudinal direction of the opening 76A at a position near the opening 76A in the casing member 76.

The developing roller 74 includes a rotatable cylindrical developing sleeve 74A and a magnetic unit 74B fixed to the inner surface of the developing sleeve 74A and including plural magnetic poles. In the developing roller 74, a magnetic brush made of the developer (carrier) is formed as the developing sleeve 74A is rotated, and the thickness of the magnetic brush is regulated by the regulating member 79. Thus, the developer layer is formed on the outer peripheral surface of the developing sleeve 74A. The developer layer on the outer peripheral surface of the developing sleeve 74A is moved to the position where the developing sleeve 74A faces the photoconductor 62. Accordingly, the toner adheres to the latent image (electrostatic latent image) formed on the outer peripheral surface of the photoconductor 62. Thus, the latent image is developed.

Two helical transport rollers 77 are rotatably arranged in parallel to each other in the casing member 76. The two transport rollers 77 rotate so as to circulate the developer contained in the casing member 76 in the axial direction of the developing roller 74 (longitudinal direction of the developing unit 72Y). Six developing rollers 74 are included in the respective developing units 72Y, 72M, 72C, 72K, 72E, and 72F, and are arranged along the circumferential direction so as to be separated form each other by 60° in terms of the central angle. When the developing units 72 are switched, the developing roller 74 in the newly selected developing unit 72 is caused to face the outer peripheral surface of the photoconductor 62.

An image forming process performed by the image forming apparatus 10 will be described.

Referring to FIG. 1, when the image forming apparatus 10 is activated, image data of respective colors, which are yellow (Y), magenta (M), cyan (C), black (K), the first specific color (E), and the second specific color (F), are successively output to the exposure device 66 from an image processing device (not shown) or an external device. At this time, the developing device 70 is held such that the developing unit 72Y, for example, is opposed to the outer peripheral surface of the photoconductor 62 (see FIG. 2).

The exposure device 66 emits light in accordance with the image data, and the outer peripheral surface of the photoconductor 62, which has been charged by the charging device 64, is exposed to the emitted light. Accordingly, an electrostatic latent image corresponding to the yellow image data is formed on the surface of the photoconductor 62. The electrostatic latent image formed on the surface of the photoconductor 62 is developed as a yellow toner image by the developing unit 72Y. The yellow toner image on the surface of the photoconductor 62 is transferred onto the intermediate transfer belt 68 by the first transfer roller 67.

Then, referring to FIG. 1, the developing device 70 is rotated by 60° in the direction shown by arrow +R, so that the developing unit 72M is opposed to the surface of the photoconductor 62. Then, the charging process, the exposure process, and the developing process are performed so that a magenta toner image is formed on the surface of the photoconductor 62. The magenta toner image is transferred onto the yellow toner image on the intermediate transfer belt 68 by the first transfer roller 67. Similarly, cyan (C) and black (K) toner images and toner images of the first specific color (E) and the second specific color (F) are successively transferred onto the intermediate transfer belt 68.

A sheet of recording paper P is fed from the sheet storing section 12 and transported along the transport path 28. Then, the sheet is transported by the positioning rollers 38 to the second transfer position in synchronization with the time at which the toner images are transferred onto the intermediate transfer belt 68 in a superimposed manner. Then, the second transfer process is performed in which the toner images that have been transferred onto the intermediate transfer belt 68 in a superimposed manner are transferred by the second transfer roller 71 onto the sheet of recording paper P that has been transported to the second transfer position.

The sheet of recording paper P onto which the toner images have been transferred is transported toward the fixing device 80 in the direction shown by arrow A (rightward in FIG. 1). The fixing device 80 fixes the toner images on the sheet of recording paper P by applying heat and pressure thereto with the heating roller 82 and the pressing roller 84. The sheet of recording paper P on which the toner images are fixed are ejected to, for example, the paper output unit 15. When images are to be formed on both sides of the sheet of recording paper P, the following process is performed. That is, after the toner images on the front surface of the sheet of recording paper P are fixed by the fixing device 80, the sheet is transported to the reversing unit 33 and reversed. Then, the sheet is transported to the second transfer position. Then, the back surface of the sheet of recording paper P is subjected to the image forming process and the fixing process.

Electrical Connection Structure

Next, an electrical connection structure according to the present exemplary embodiment will be described.

Figure 3:
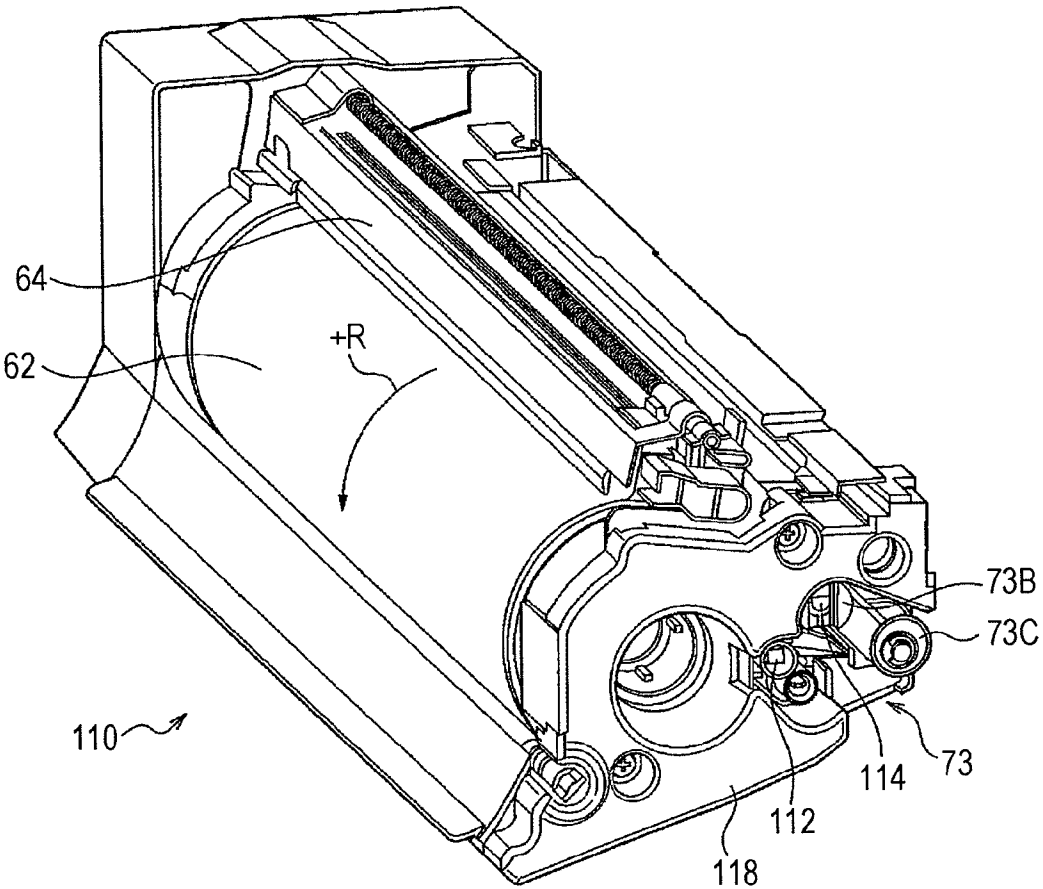
FIG. 3 is a perspective view illustrating the structure of a process cartridge according to the exemplary embodiment.

Referring to FIG. 3, the photoconductor 62, the charging device 64, and the cleaning device 73 are integrated as a process cartridge 110. The process cartridge 110 is detachably attached to the image forming unit 14.

The cleaning device 73 includes an electric terminal 112, which is an example of a power supplying member, for receiving electric power from the image forming unit 14 when the process cartridge 110 is attached to the image forming unit 14. The electric power received by the electric terminal 112 is supplied to the brush roller 73B, which is an example of a member to be charged. The brush roller 73B is charged by the received electric power so as to attract the residual toner and the like on the surface of the photoconductor 62. More specifically, the brush roller 73B is disposed adjacent to the photoconductor 62 and is rotated by the rotation of the photoconductor 62. The residual toner and the like on the surface of the photoconductor 62 adhere to the brush roller 73B at the position where the photoconductor 62 and the brush roller 73B are in contact with each other. Thus, the photoconductor 62 is cleaned. The residual toner and the like on the brush roller 73B are removed therefrom by a flicker member (not shown) that is in contact with the brush roller 73B.

The brush roller 73B includes a rotational shaft 114 composed of a conductive member made of, for example, iron. The electric terminal 112 is provided with an electrical contact portion 112*a* that is pressed against the rotational shaft 114 so that the electric terminal 112 is electrically connected to the brush roller 73B.

FIGS. 4 to 8 illustrate the manner in which the electrical contact portion 112*a* is assembled to the rotational shaft 114 of the brush roller 73B. FIGS. 4 to 8 illustrate the state in which the photoconductor 62, the charging device 64, and a housing cover 118 (see FIG. 3) are detached.

Figure 4:
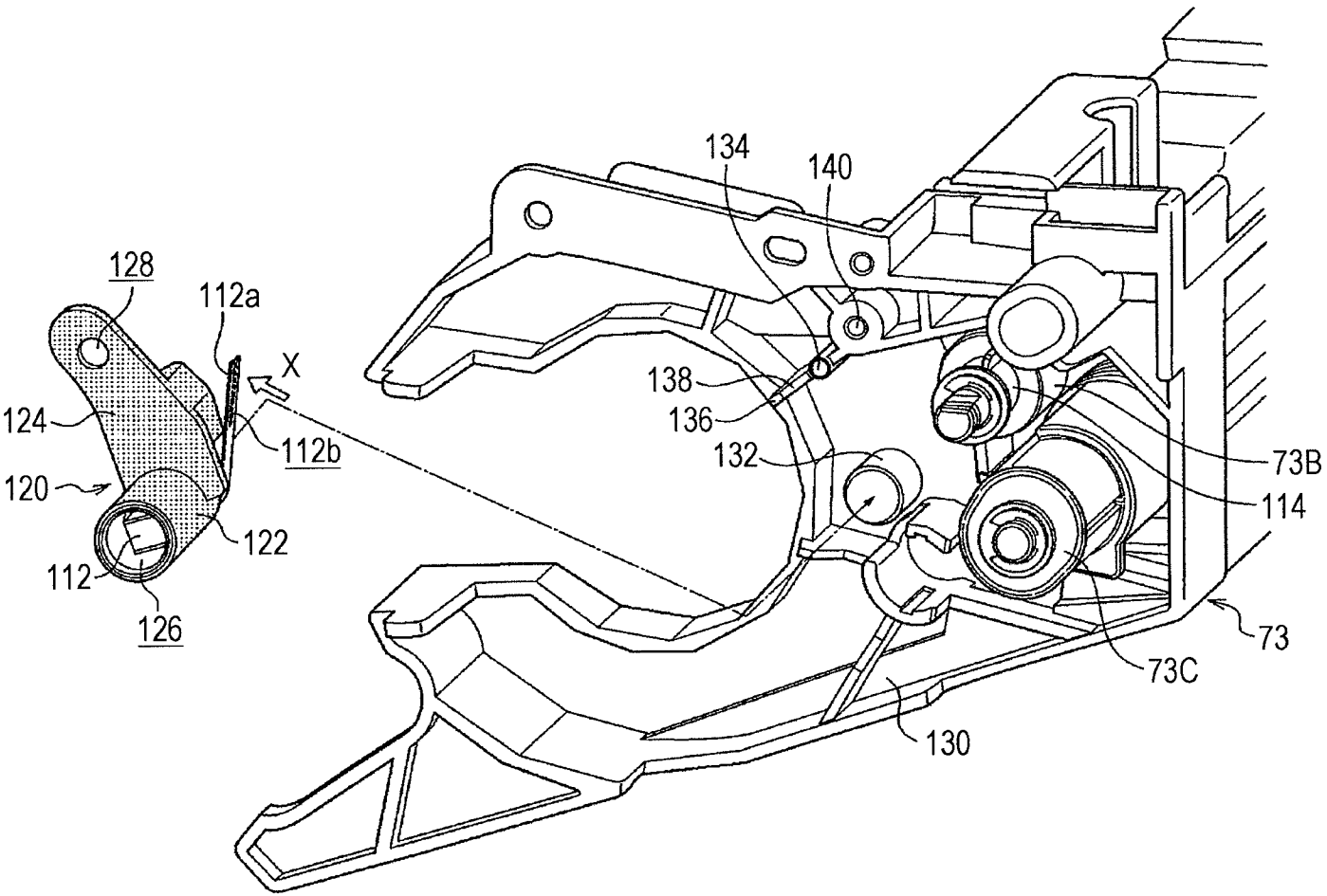
FIG. 4 is a perspective view illustrating the manner in which an electrical contact portion is assembled to a rotational shaft of a brush roller in an electrical connection structure according to the exemplary embodiment.

Referring to FIG. 4, the electric terminal 112 provided with the electrical contact portion 112*a* is provided on a holder 120. The holder 120 includes a cylindrical holder body 122 that is open at an end thereof and a flange portion 124 provided on the outer peripheral surface of the holder body 122. The electric terminal 112 is placed in an inner cylindrical portion 126 of the holder body 122. The flange portion 124 has an insertion hole 128 for receiving a screw at an end thereof.

The electrical contact portion 112*a* is composed of a thin, narrow, elongated metal plate made of a conductive material, such as iron and copper. The electrical contact portion 112*a* is attached to the holder body 122 of the holder 120 at a proximal end thereof, and a distal end of the electrical contact portion 112*a* projects from the holder body 122 in the tangential direction. Therefore, when an external force is applied to the electrical contact portion 112*a* of the electric terminal 112 in a direction shown by arrow X (direction orthogonal to the tangential direction), the electrical contact portion 112*a* is elastically deformed along a curve. Thus, the electrical contact portion 112*a* is retained by the holder 120 in an elastically deformable manner, and has a function of a leaf spring.

A groove 112*b* that extends in the longitudinal direction of the electrical contact portion 112*a* is formed in the electrical contact portion 112*a* at the distal end thereof.

A first boss 132, which is an example of a guiding member, is formed on a housing 130 of the process cartridge 110. The first boss 132 has a cylindrical or substantially cylindrical shape, and is formed so as to project perpendicularly from the housing 130. A second boss 134, which is an example of a restraining member, is located at the upper left of the first boss 132 in FIG. 4. The second boss 134 is provided adjacent to a rib 136 of the housing 130. The amount by which the second boss 134 projects from the housing 130 is smaller than the amount by which the rib 136 projects from the housing 130. An inclined surface 138 that connects the top of the rib 136 to the top of the second boss 134 is provided between the rib 136 and the second boss 134. A screw hole 140 is provided at the upper right of the second boss 134 in FIG. 4.

A first boss 132 is fitted to the inner cylindrical portion 126 of the holder body 122 of the holder 120 and guides the movement of the holder 120. A clearance (design leeway) is provided between the outer peripheral surface of the first boss 132 and an inner peripheral surface of the inner cylindrical portion 126. The clearance is large enough to allow the holder 120 to slide along the first boss 132 in an insertion direction and rotate along the outer peripheral surface of the first boss 132 after the insertion.

Figure 5:
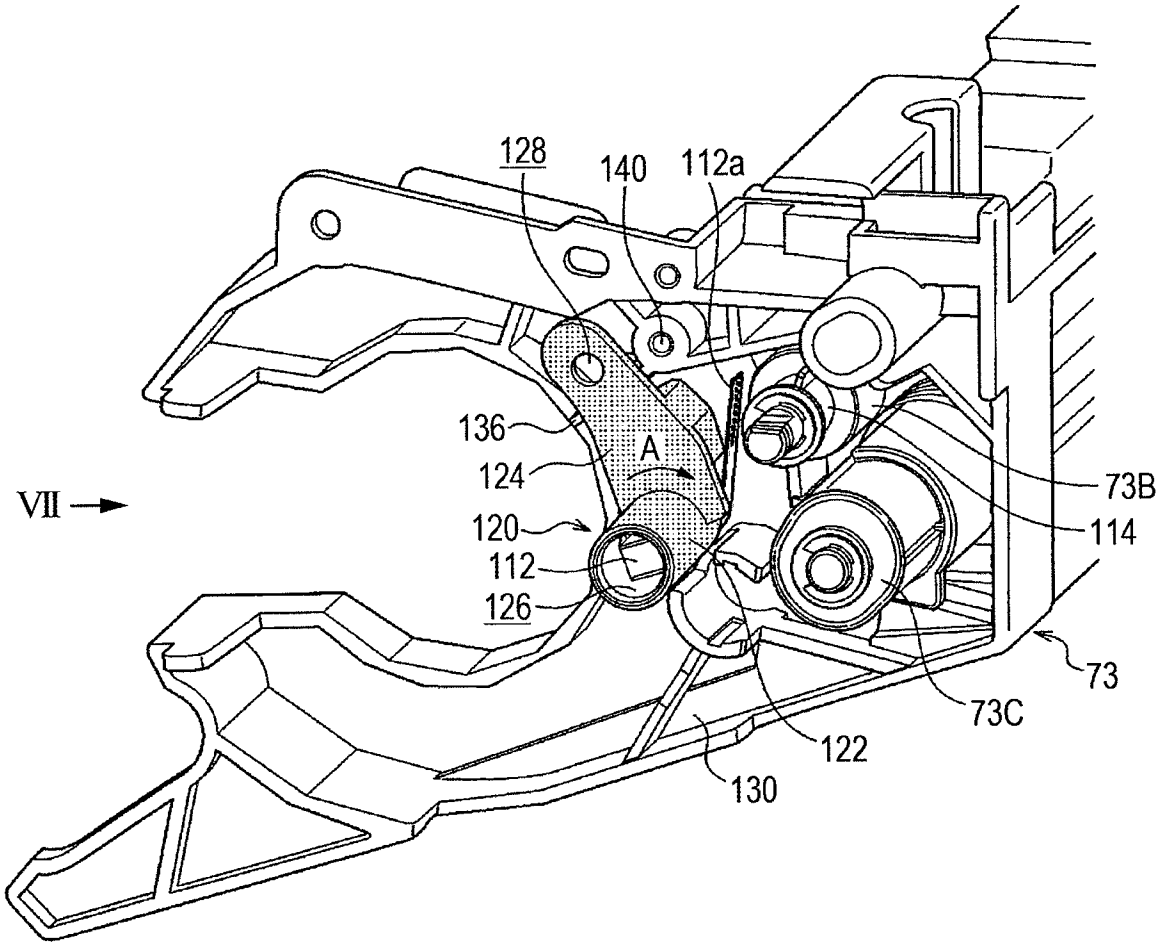
FIG. 5 is another perspective view illustrating the manner in which the electrical contact portion is assembled to the rotational shaft of the brush roller in the electrical connection structure according to the exemplary embodiment.
Figure 7:
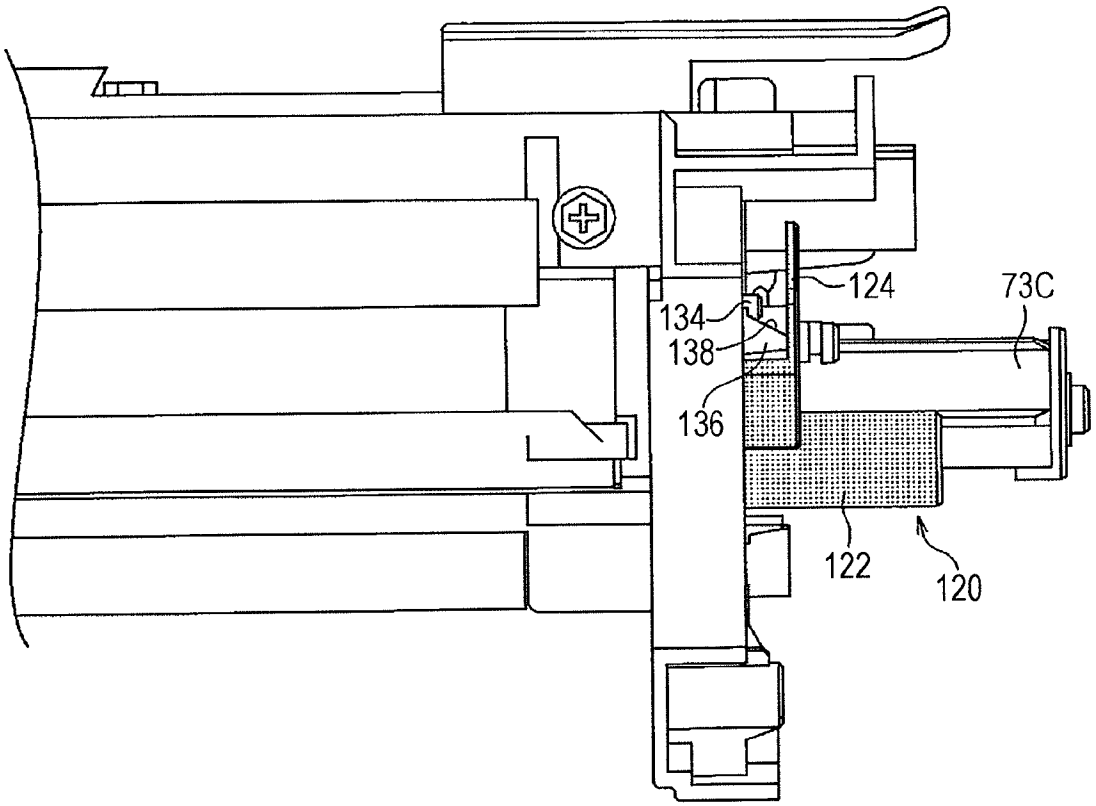
FIG. 7 is a side view illustrating the manner in which the electrical contact portion is assembled to the rotational shaft of the brush roller in the electrical connection structure according to the exemplary embodiment, viewed in the direction shown by arrow VII in FIG. 5.

The process of attaching the holder 120 which holds the electrical contact portion 112*a* will now be described. First, as illustrated in FIGS. 5 and 7, the holder 120 is fitted to the first boss 132 such that the flange portion 124 of the holder 120 abuts against the top portion of the rib 136. Then, the holder 120 is rotated around the first boss 132 in the direction shown by arrow A, which is an example of a first direction. Accordingly, the electrical contact portion 112*a* is pressed against the rotational shaft 114 of the brush roller 73B (more accurately, against a sleeve that is slidably fitted to the rotational shaft 114). As a result, the electrical contact portion 112*a* receives an external force from the rotational shaft 114 of the brush roller 73B and is elastically deformed.

Figure 6:
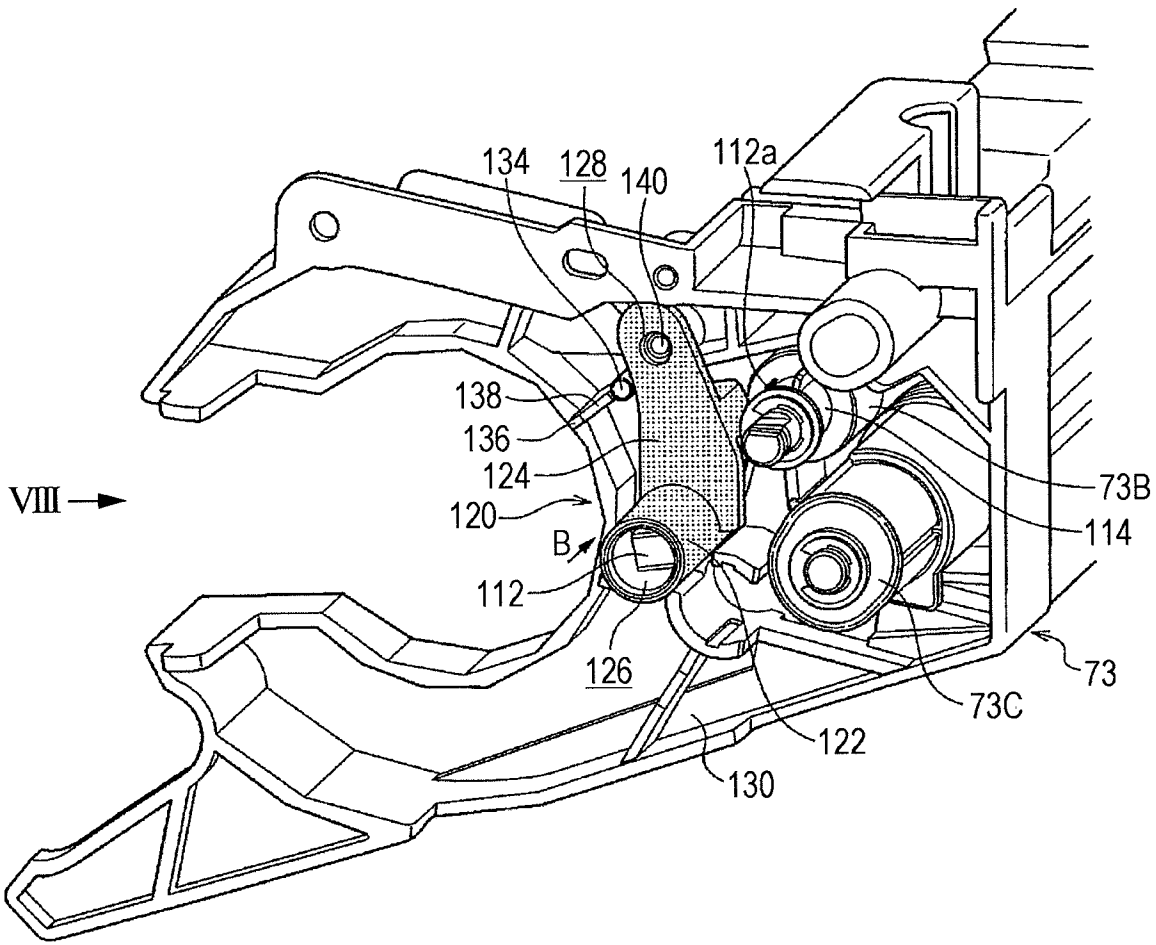
FIG. 6 is another perspective view illustrating the manner in which the electrical contact portion is assembled to the rotational shaft of the brush roller in the electrical connection structure according to the exemplary embodiment.
Figure 8:
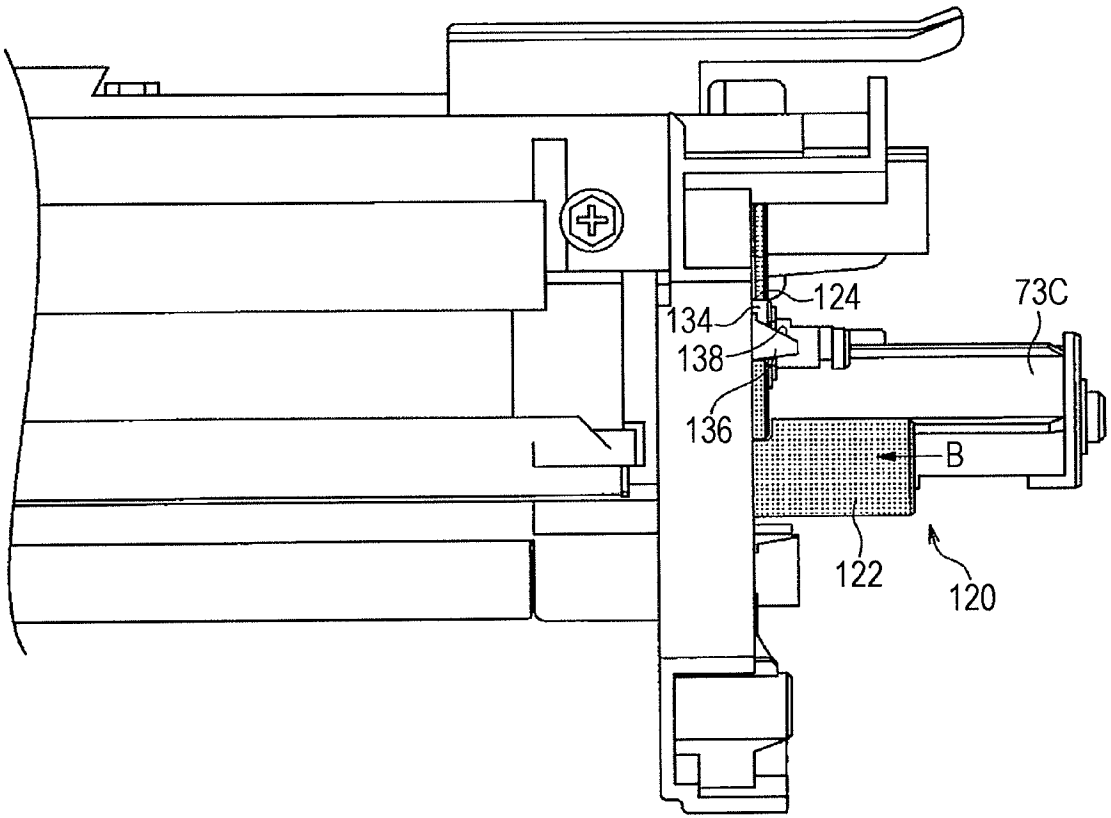
FIG. 8 is a side view illustrating the manner in which the electrical contact portion is assembled to the rotational shaft of the brush roller in the electrical connection structure according to the exemplary embodiment, viewed in the direction shown by arrow VIII in FIG. 6.

Then, as illustrated in FIGS. 6 and 8, the holder 120 is further moved in the direction shown by arrow B, which is an example of a second direction, so that the first boss 132 is further inserted into the holder 120. Accordingly, the flange portion 124 of the holder 120 comes into contact with a side surface of the second boss 134.

Since the electrical contact portion 112*a* functions as a leaf spring, the holder 120 receives an elastic reaction force. However, the movement of the holder 120 in the direction opposite to the direction shown by arrow A is restrained by the second boss 134, so that the state in which the electrical contact portion 112*a* is pressed against the rotational shaft 114 of the brush roller 73B is maintained.

Thus, when the holder 120 is moved to a position where the holder 120 is restrained by the second boss 134, the electrical contact portion 112*a* is moved to a predetermined contact position on the rotational shaft 114 of the brush roller 73B. In addition, the insertion hole 128 in the flange portion 124 is moved to a position corresponding to the screw hole 140 formed in the housing 130. Thus, the holder 120 is retained at a position where the holder 120 may be fastened to the housing 130 with a screw.

As described above, the electrical contact portion 112*a* is assembled to the rotational shaft 114 of the brush roller 73B such that the electrical contact portion 112*a* is elastically deformed and pressed against the rotational shaft 114. More specifically, the holder 120 that retains the electrical contact portion 112*a*, which has elasticity, in an elastically deformable manner is rotated such that the electrical contact portion 112*a* is pressed against the rotational shaft 114 and is elastically deformed. Then, the holder 120 is further pushed so that the first boss 132 is further inserted into the holder 120. At that position, the second boss 134 restrains the holder 120 from being moved by the elastic reaction force. The rotation and movement in the insertion direction of the holder 120 are guided by the first boss 132.

Thus, in the electrical connection structure in which the electrical contact portion 112*a* having elasticity is elastically deformed and pressed against the rotational shaft 114 of the brush roller 73B to provide an electrical connection between the electrical contact portion 112*a* and the rotational shaft 114, the electrical contact portion 112*a* may be easily assembled to the rotational shaft 114.

In addition, the inclined surface 138 provided between the rib 136 and the second boss 134 guides the holder 120 when the holder 120 is rotated and moved with respect to the first boss 132 such that the first boss 132 is inserted into the holder 120. Therefore, the holder 120 may be rotated and moved in the insertion direction at substantially the same time. This further facilitates the assembly of the electrical contact portion 112*a*.

The second boss 134 restrains the movement of the holder 120 such that the state in which the electrical contact portion 112*a* is pressed against the rotational shaft 114 of the brush roller 73B is maintained. In this state, the holder 120 is retained at a position where the holder 120 may be fastened to the housing 130 with a screw. This allows an assembly worker to easily fasten the holder 120 to the housing 130 with a screw by one hand without holding the holder 120.

Although an electrical connection structure applied to the rotational shaft 114 of the brush roller 73B is described in the present exemplary embodiment as an example, the electrical connection structure is not limited to this, and may be applied to all components for which an electrical connection is to be provided with an electrical contact portion that is elastically deformable. For example, the electrical connection structure may be applied to various transport rollers including the transport rollers around which the intermediate transfer belt 68 is wound, the developing roller 74, etc.

In addition, although the insertion hole 128 and the screw hole 140 for fastening the holder 120 to the housing 130 are provided in the above-described example, a retaining hook that prevents the holder 120 from moving in the direction opposite to the direction shown by arrow B may be provided instead.

In the present exemplary embodiment, the case in which the image forming process is performed using the six colors, which are Y, M, C, K, E, and F, is described. However, the image forming process may be performed using four colors, which are Y, M, C, and K, or five colors, which are Y, M, C, K, and one of the first and second specific colors E and F.

In addition, in the present exemplary embodiment, the developing device 70 includes six developing units for the respective colors arranged with constant intervals of 60°. Alternatively, however, the developing device may include four developing units for the respective colors arranged with constant intervals of 90°.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrical connection structure comprising:

a holder that holds an electric terminal provided with an electrical contact portion having elasticity, the electric terminal being held such that the electrical contact portion is elastically deformable;

a guiding member fitted to the holder and capable of guiding the holder in a first direction and a second direction to move the electrical contact portion to a predetermined contact position on a conductive member, the first direction being a direction in which the electrical contact portion is elastically deformed by being pressed against the conductive member and the second direction being substantially orthogonal to the first direction; and a restraining member that comes into contact with the holder that has been guided by the guiding member to move the electrical contact portion to the contact position, the restraining member restraining the holder from being moved in a direction opposite to the first direction by an elastic reaction force applied to the holder.

2. The electrical connection structure according to claim 1, wherein the guiding member has a substantially cylindrical shape and is slidably fitted into a substantially circular hole that is formed in the holder.

3. The electrical connection structure according to claim 1, wherein the holder includes a cylindrical portion and the electric terminal is fixed to the cylindrical portion.

4. An image forming apparatus, comprising:

a member to be charged that is charged to attract toner used to form an image;

a power supplying member capable of supplying electric power for charging the member to be charged;

a conductive member that is provided on the member to be charged; and an electrical connection structure that includes a holder that holds an electric terminal provided with an electrical contact portion having elasticity, a guiding member having a substantially cylindrical shape, the guiding member being fitted to the holder slidably and capable of guiding the holder in a first direction and a second direction to move the electrical contact portion to a predetermined contact position on the conductive member, the first direction being a direction in which the electrical contact portion is elastically deformed by being pressed against the conductive member and the second direction being substantially orthogonal to the first direction, and a restraining member that comes into contact with the holder that has been guided by the guiding member to move the electrical contact portion to the contact position, the restraining member restraining the holder from being moved in a direction opposite to the first direction by an elastic reaction force applied to the holder, wherein the electrical connection structure electrically connects the conductive member to the power supplying member.

5. The image forming apparatus according to claim 4, wherein the guiding member has a substantially cylindrical shape and is slidably fitted into a substantially circular hole that is formed in the holder.

6. An electrical connection method comprising:

holding an electric terminal provided with an electrical contact portion having elasticity with a holder, the electric terminal being held such that the electrical contact portion is elastically deformable;

guiding the holder with a guiding member in a first direction and a second direction to move the electrical contact portion to a predetermined contact position on a conductive member, the first direction being a direction in which the electrical contact portion is elastically deformed by being pressed against the conductive member and the second direction being substantially orthogonal to the first direction; and bringing a restraining member into contact with the holder that has been guided by the guiding member to move the electrical contact portion to the contact position and restraining the holder from being moved in a direction opposite to the first direction by an elastic reaction force applied to the holder.

7. An electrical connection member attachable to an apparatus, comprising:

a holder that holds an electric terminal and has a cylindrical portion, the electric terminal having an electrical contact portion having elasticity, wherein the cylindrical portion is fitted to a guiding member that is included in the apparatus, wherein the electrical contact portion is elastically deformed by rotating the holder in a direction and moved to a predetermined contact position on a conductive member that is included in the apparatus, and wherein a restraining member restraining the holder from being moved in a direction opposite to the direction by an elastic reaction force applied to the holder is included in the apparatus.

8. The electrical connection member according to claim 7, wherein the guiding member has a substantially cylindrical shape and is slidably fitted to the cylindrical portion.

9. The electrical connection member according to claim 7, wherein the holder includes a cylindrical portion and the electric terminal is fixed to the cylindrical portion.

10. An image forming apparatus, comprising:

a member to be charged that is charged to attract toner used to form an image;

a power supplying member capable of supplying electric power for charging the member to be charged;

a conductive member that is provided on the member to be charged;

the guiding member;

the restraining member; and the electrical connection member according to claim 7, the electrical connection member electrically connecting the conductive member to the power supplying member.

11. The image forming apparatus according to claim 10, wherein the guiding member has a substantially cylindrical shape, and the cylindrical portion is slidably fitted to the guiding member.

* * * * *